US006733051B1

(12) United States Patent
Cowper

(10) Patent No.: US 6,733,051 B1
(45) Date of Patent: May 11, 2004

(54) DOOR FASTENING DEVICE

(75) Inventor: Brian Edward Cowper, Surrey (GB)

(73) Assignee: Banham Patent Locks Limited, London (GB)

( * ) Notice: Subject to any disclaimer, the term of this patent is extended or adjusted under 35 U.S.C. 154(b) by 0 days.

(21) Appl. No.: 09/890,485

(22) PCT Filed: Nov. 23, 2000

(86) PCT No.: PCT/GB00/04442

§ 371 (c)(1),
(2), (4) Date: Jul. 31, 2001

(87) PCT Pub. No.: WO01/42600

PCT Pub. Date: Jun. 14, 2001

(51) Int. Cl.[7] ..... E05C 3/06

(52) U.S. Cl. ..... 292/196; 292/3; 292/5; 292/192; 292/DIG. 46

(58) Field of Search ..... 292/196, 195, 292/192, 2, 3, 5, DIG. 46

(56) References Cited

U.S. PATENT DOCUMENTS

| | | | | | |
|---|---|---|---|---|---|
| 980,131 | A | * | 12/1910 | Shean | 292/36 |
| 1,059,530 | A | * | 4/1913 | Dupuis | 292/341.19 |
| 1,216,765 | A | * | 2/1917 | Anderson | 292/44 |
| 2,401,854 | A | * | 6/1946 | Berry | 292/341.19 |
| 3,762,751 | A | * | 10/1973 | Little | 292/196 |
| 3,788,679 | A | | 1/1974 | Banham | |
| 5,820,170 | A | * | 10/1998 | Clancy | 292/26 |
| 5,906,403 | A | * | 5/1999 | Bestler et al. | 292/26 |
| 6,068,304 | A | * | 5/2000 | Lindqvist | 292/1 |
| 6,152,498 | A | * | 11/2000 | Lindqvist | 292/53 |
| 6,264,252 | B1 | * | 7/2001 | Clancy | 292/196 |

FOREIGN PATENT DOCUMENTS

| | | | | |
|---|---|---|---|---|
| FR | 216718 A2 | * | 1/1987 | |
| FR | 2616837 A1 | * | 12/1988 | 70/452 |
| GB | 1173299 | | 9/1920 | |
| GB | 321113 | | 11/1929 | |
| GB | 395910 | | 10/1932 | |
| GB | 2 299 612 A | | 7/1996 | |

* cited by examiner

*Primary Examiner*—William L. Miller
*Assistant Examiner*—Carlos Lugo
(74) *Attorney, Agent, or Firm*—Wells St. John P.S.

(57) ABSTRACT

A door fastening device comprising a bolt movable between a retracted position and an extended position where at least part of the bolt extends, in use, to fasten the door, the bolt being linked to an abutment member, the part of the bolt being movable to its extended position in engagement, in use, of a bolt member of a lock or latch of the door with the abutment member, the abutment member being a cam which is adjustable to compensate for different clearances, in use, between the device and the door in its closed position, to ensure sufficient engagement of the abutment member by the bolt member to move the part of the bolt to its extended position, and the cam having a flat, first surface and a second surface on a nose part.

30 Claims, 3 Drawing Sheets

DOOR FASTENING DEVICE

ROSS REFERENCE TO RELATED APPLICATION

This application claims priority from PCT International Application Number PCT/GB00/04442, which was filed 23 Nov. 2000 (23.11.00), and was published in English.

FIELD OF THE INVENTION

This invention relates to a door fastening device in which a bolt is arranged so that, in use, it is operated by the shooting of the deadbolt or latch of a lock of the door to assume a position in which it prevents the opening of the door until the deadbolt or latch bolt is withdrawn. The device may be secured to a side of the door frame jamb, or may be received in a mortice in said jamb.

BACKGROUND OF THE INVENTION

In the door fastening device disclosed in U.K. Patent Specification No. 321,113 the door lock bolt, when extended, acts on an arm carried on one end of a spindle, on the other end of which is a lever which engages one of a pair of linked swivel bolts to cause both swivel bolts to extend into respective box staples on the door to hold it closed. To allow for differences in the amount of movement of the latches or bolts according to the different types of locks with which the device is used, adjustment means in the form of an adjustable stop is provided on the arm where it is engaged by the door lock bolt.

SUMMARY OF THE INVENTION

This invention relates to a door fastening device in which a bolt is arranged so that, in use, it is operated by the shooting of the deadbolt or latch of a lock of the door to assume a position in which it prevents the opening of the door until the deadbolt or latch bolt is withdrawn. The device may be secured to a side of the door frame jamb, or may be received in a mortice in said jamb.

According to a first aspect of the invention a door fastening device comprises a casing, a bolt movable between a retracted position and an extended position where at least part of the bolt extends through an opening in the casing to fasten the door, in use, the bolt being linked to an abutment member, said part of the bolt being movable to its extended position by engagement, in use, of a bolt member of a lock or latch of the door with said abutment member, said abutment member being adjustable to compensate for different clearances, in use, between the casing and the door in its closed position, to ensure sufficient engagement of the abutment member by the bolt member to move said part of the bolt to its extended position, a faceplate with an opening for passage of said bolt member, and means for relative fixing adjustment between the faceplate and the casing to compensate for different relative dispositions, in use, between the door and the casing.

According to a second aspect of the invention a door fastening device comprises a bolt movable between a retracted position and an extended position where at least part of the bolt extends, in use, to fasten the door, the bolt being linked to an abutment member, said part of the bolt being movable to its extended position by engagement, in use, of a bolt member of a lock or latch of the door with said abutment member, said abutment member being a cam which is adjustable to compensate for different clearances, in use, between the device and the door in its closed position, to ensure sufficient engagement of the abutment member by the bolt member to move said part of the bolt to its extended position, and the cam having a flat, first surface and a second surface on a nose part.

Preferably the flat surface extends across the whole axial length of the cam, whilst said second surface extends axially for only part thereof. Desirably said second surface is arcuate.

BRIEF DESCRIPTION OF THE VIEWS OF THE DRAWINGS

The invention will now be described, by way of example, with reference to the accompanying drawings, in which.

DETAILED DESCRIPTION OF THE INVENTION

Figure 1:
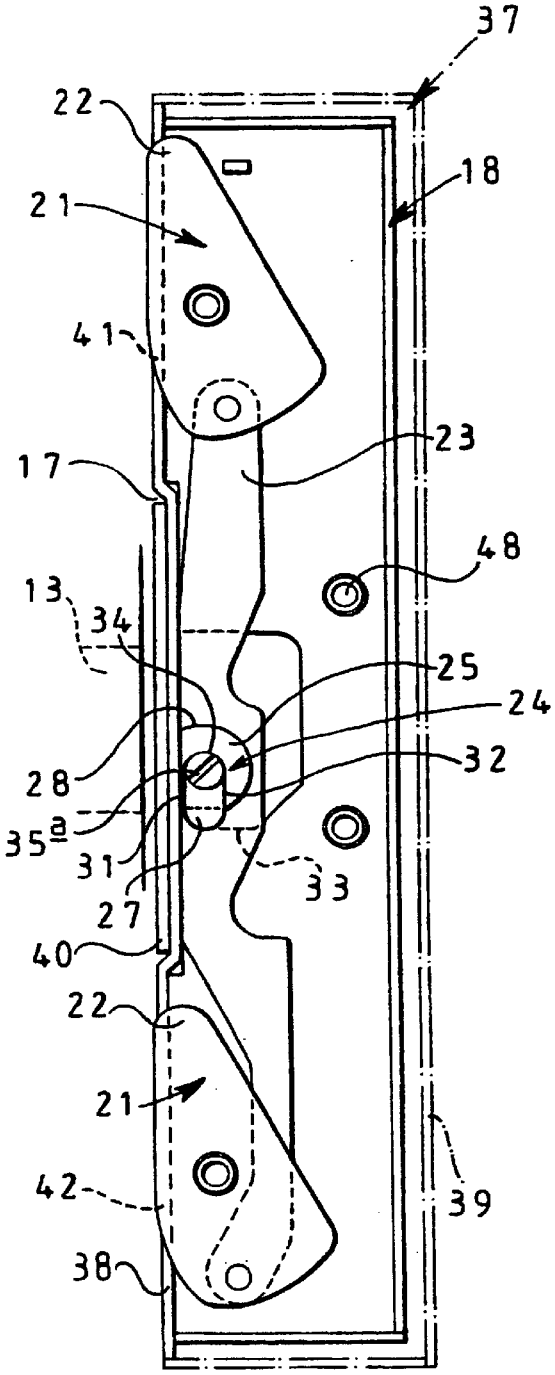
FIG.1 is a schematic view showing the interior of a fastening device of the invention, in use, adjacent a close fitting door, with bolts of the device retracted.

In the drawings, which illustrate a preferred construction according to the invention, there is shown a jamb 10 of a door frame to which, in the conventional manner is hingedly secured a door 11. Basically the invention relates to a door fastening device, at least one bolt of which is caused to extend from the frame when a bolt member of a lock at the door extends, the extended bolt of the frame preventing opening of the door, along with the bolt member itself, until retraction of said bolt member, whereupon the bolt of the door fastening device automatically retracts to allow opening of the door. The invention does not relate to the type of door lock used, and accordingly the door lock and/or the door fastening device associated with the frame could be received in a mortice in the door or frame edge, or could instead be fixed at a side of the door or frame such as with a rim lock. Indeed this is the construction illustrated in the Figures, perhaps best shown with respect to FIGS. 5 and 6.

Accordingly, as illustrated, the door 11 is shown with a lock 12 having a spring loaded bolt 13 of conventional form, the lock 12 being secured at one side surface 14 of the door so as to lie flush with a front edge surface 15, with which edge surface the front end of the bolt 13 is flush when in its retracted position. The jamb 10 has secured to its side surface 16 a door fastening device of the invention, with the front part thereof being flush with the front edge surface 17 of the jamb. Instead of the spring loaded bolt 13 being part of a lock, it could be part of a latch.

The door fastening device comprises an elongate rectangular steel housing 18 between the spaced parallel side walls 19,20 of which, at opposite ends of the housing, are pivotally mounted respective swivel bolts 21 which may, for example, be of laminar form made up of a series of plates. Each bolt has a rounded nose part 22 at one side of its pivot, and at its opposite side there is a respective pivotal connection of a link 23 which connects the bolts 21 for movement together between their retracted state, as shown in FIGS. 1 and 3 where the bolts are received substantially in the housing 18 with their respective outermost surfaces flush with the edge surface 17 of the jamb, to the extended position shown in FIGS. 2 and 4 where the swivel bolts extend beyond said front edge 17 so that said nose parts 22 lie across the face of the door, and can be received, for example, in respective cover boxes fixed to said face of the door. If the lock 12 and door fastening device were to be morticed in the door and door frame jamb, then the extended swivel bolts would, for example, be received in recesses in the front edge surface of the door.

At the centre of the housing 18, the respective side walls 19,20, are cut away and to one side of the link 23, depending upon the handing of the device, is fitted an abutment member 24 which extends laterally of the housing through the opening in the side wall 19, or 20 formed by said cutting away of said wall. The abutment member 24 is in the form of a cam having a base part 25 which contacts the link 23, a main body part 26 and a nose part 27 extending from the main body part 26 as will be described.

As can be determined from the drawings, the base part 25 has a part-circular outer surface portion 28, with said outer surface being completed by a first straight outer surface portion 29 extending from one end of the portion 28 and a second straight outer surface portion 30 extending from the other end of the portion 28, the two straight surface portions meeting at 90°. The main body part 26 is of generally rectangular shape with respective flat parallel sides 31,32, but with one flat end surface 33 and an opposite end surface 34 which is arcuate. This arcuate surface 34 has the same centre as the base part 25 and a headed fixing screw 35, with a screwdriver slot 35*a* or an hexagonal recess therein, is received through the abutment member 24 along said common axis, the screw being received in a complementarily threaded hole in the link 23 so as adjustably to secure the cam to the link. The underside of the base part 25 can be recessed to receive a spring locking washer through which the screw 35 passes. Finally with regard to the cam, it can be seen that whilst the flat surfaces 31,32, and the arcuate end surface 34 extend for the whole lateral width of the cam, the flat end surface 33 extends for only approximately half of this lateral width, whereupon it terminates at the nose part 27 which is formed as a continuation of the two flat sides 31,32, and has an arcuate end surface 36 of the same form as the end surface 34. It can be seen that the flat side 31 of the main body part 26 forms a continuation of the straight outer surface portion 29, whilst the flat end surface 33 of the part 26 forms a continuation of the straight outer surface portion 30 of the part 25. It will thus be appreciated that the tip of the nose part 27 is radially further from the axis of rotation of the cam than the surface 31.

The housing 18 is fitted within a rectangular casing or cover box 37 which has spaced parallel side walls 38,39 respectively defining an open side to the box. The side wall 38 is approximately twice as long as the side wall 39 and has various slots and holes therein. In addition its central portion is slightly recessed across the whole of its lateral extent, as shown in FIGS. 1 to 4, to accommodate a steel faceplate 40, again as will be described.

Figure 5:
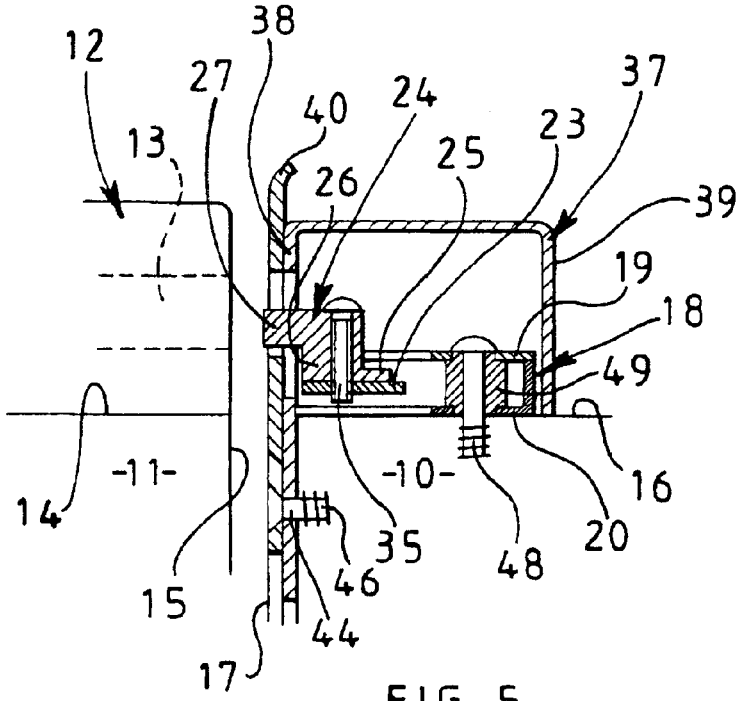
FIG. 5 is a schematic horizontal part-sectional view through a device of the invention and an adjacent door lock, where a surface of the door frame to which the device is fitted is in line with a surface of the door to which the door lock is fitted.
Figure 6:
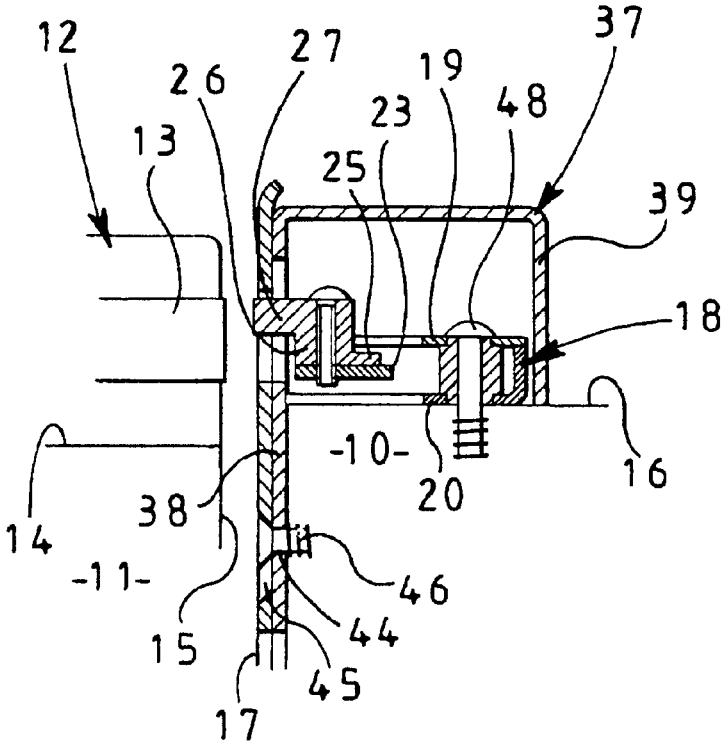
FIG. 6 is a view corresponding to FIG. 5, where the respective door and door frame surfaces are out of alignment, with a faceplate of the device adjusted to compensate accordingly.

The side wall 38 has respective upper and lower rectangular slots 41,42 to allow passage of the swivel bolts 21 between their extended and retracted positions, and in its recessed area, the side wall 38 has a rectangular slot 43 to receive the bolt 13 of the lock 12 when it acts on the abutment member 24 as will be described. Adjacent the slots 41,42 respectively are formed respective pairs of countersunk fixing holes (not shown) for securing the cover box to the door frame jamb 10, and the recessed portion of the side wall 38 is formed with upper and lower holes, one of which is diagrammatically illustrated at 44 in FIGS. 5 and 6. Each of said holes would normally be formed in a recessed, pressed-in part of the wall 38, which part can receive for sliding adjustment, a corresponding pressed-in part of the faceplate 40 around an elongate slot, one of which slots in the faceplate, denoted by the numeral 45, is shown in FIGS. 5 and 6. As will be described, a fixing screw 46 can be received in each of the recessed slots in the faceplate to pass through the recessed hole in the recessed part of the side wall 38, and thence into the door frame jamb as shown in FIGS. 5 and 6 to secure the faceplate relatively to the cover box in the selected adjusted position as will be described hereinafter. The faceplate 40 has a rectangular slot 47 for passage of the bolt 13 when it engages the abutment member 24.

As shown in the Figures, the housing 18 is secured in position at the side surface 16 of the door jamb by means of a pair of vertically spaced screws 48 passing through the side walls 19,20 as well as respective spacers 49 which fill the interior space between such side walls, the screw passing into the side surface of the frame. With the housing secured in place, the cover box can then be positioned over this, as shown in FIGS. 5 and 6, and secured in place by way of the fixing screws passing through the countersunk holes in the side wall 38 as described above. The bolts 21 are pivoted in the housing 18 by screws equivalent to screws 48, which thus also serve to fix the housing to surface 16, such equivalent screws also passing through spacers at opposite sides of the bolt.

Operation of the door fastening device will now be described.

Figure 2:
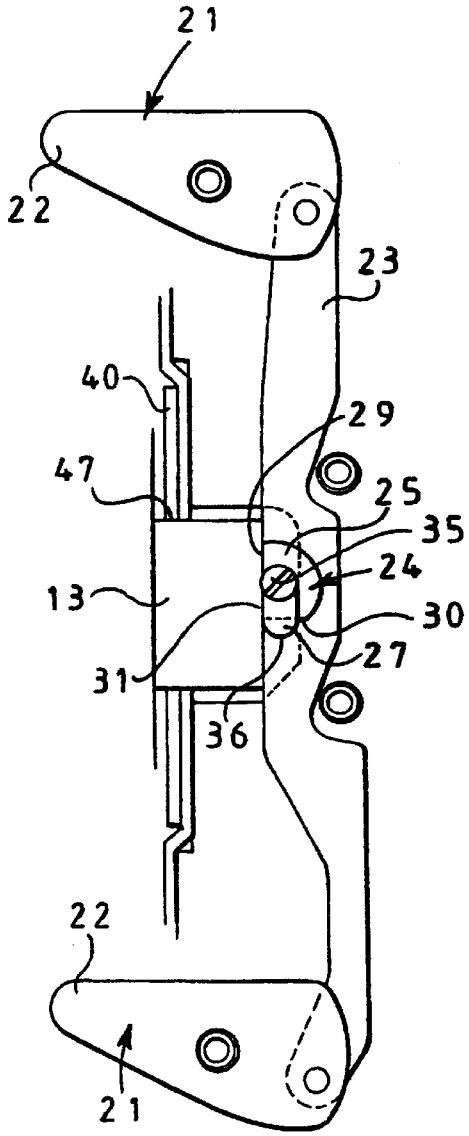
FIG. 2 is a fragmentary view showing the bolts of the device of FIG. 1 in an extended position when a bolt of a lock of the door is extended.
Figure 3:
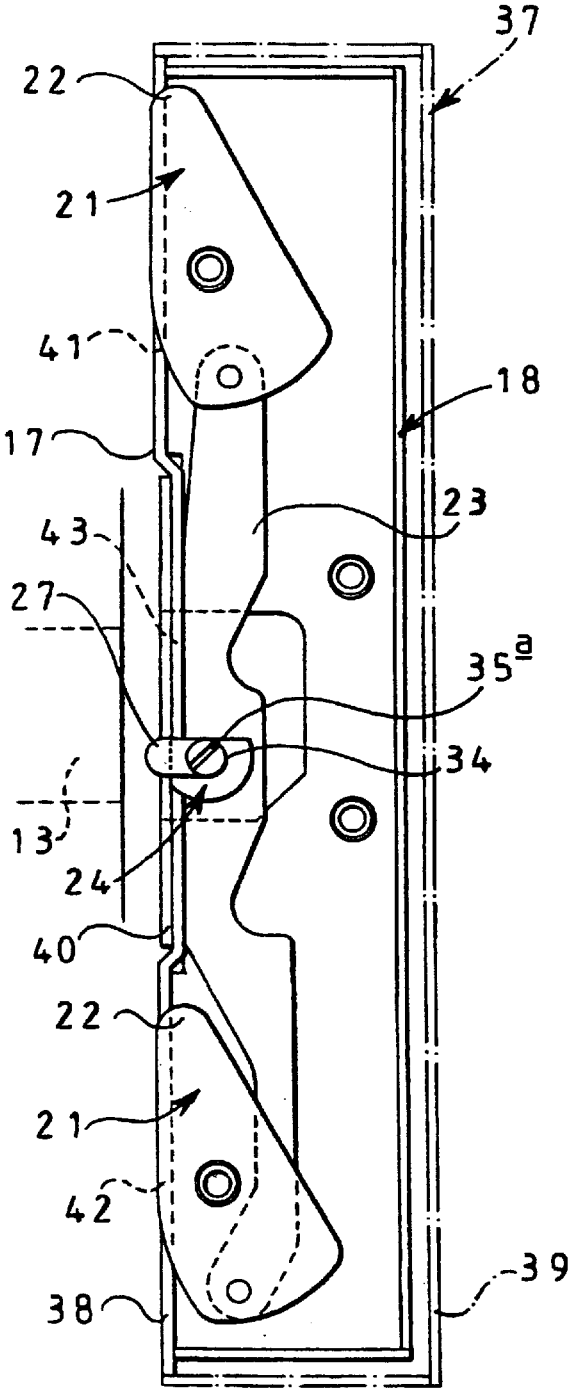
FIGS. 3 and 4 are views corresponding to FIGS. 1 and 2 respectively, for a poor, wide-gap fitting door, and with a cam of the device adjusted accordingly to compensate.

Firstly with regard to FIGS. 1 and 2, there is shown the door fastening device fitted at a door jamb of the door frame, where the door is a good close fit. In other words the clearance between the front edge surface 15 of the door and the front edge surface 17 of the jamb is minimal. In contrast, with the arrangement shown in FIGS. 3 and 4, there is illustrated a poor widegap fitting door with the front edge surface 15 of the door spaced much further apart from the front edge surface 17 of the jamb. By comparing these two (extreme) arrangements, it will be appreciated that it is necessary to ensure that extension of the bolt 13 moves the link 23 to its fully inward position in its housing so as fully to throw the swivel bolts. In FIGS. 1 and 2, it can be seen that the cam is positioned relative to the front surface of the link so that the flat side 31 of the cam is flush with the front surface of the link and faces the forward end of the bolt so as to be engaged thereby, the depth of the bolt being such that it also abuts the non-arcuate portion of the nose part 27 which merges with said side 31. With this arrangement, the minimal gap referred to between the door and the door frame jamb means that there is sufficient extension of the bolt fully to shoot the swivel bolts if the bolt does not engage the cam until it reaches the front surface of the link. Accordingly, as illustrated in FIGS. 1 and 2, the spring loaded bolt 13 will extend through the slot 47 in the faceplate, and the slot 43 in the side wall 38, and then engage the cam surfaces as described above, so as to push on said cam, pivot the link 23, and cause the swivel bolts to extend to their respective positions shown in FIG. 2, the nose part 22 of each swivel bolt passing through the rectangular slots 41,42 respectively so as to fasten the door as previously described. These swivel bolts cannot then be released until the bolt 13 is retracted, e.g. by handle or key operation, the swivel bolts then returning to their retracted positions under gravity, with the link swinging from its FIG. 2 to its FIG. 1 position.

Figure 4:
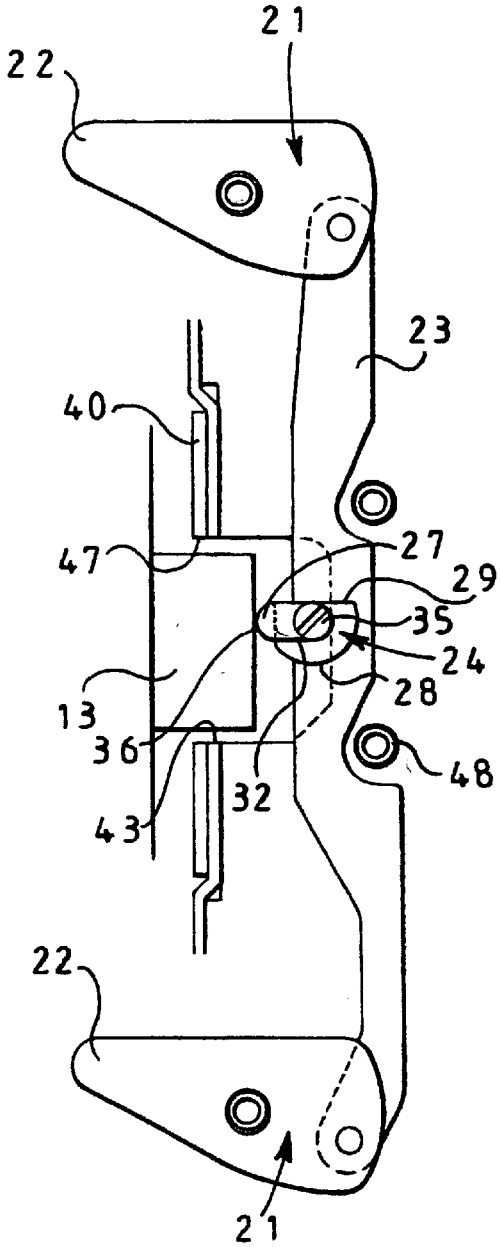

In contrast, with the arrangement shown in FIGS. 3 and 4, the increased gap between the door and the frame means that if the cam remained in its adjusted FIG. 1 position, part of the bolt extension would be taken up in clearing said gap, with the result that the link would not be moved sufficiently rearwardly so as fully to throw the swivel bolts. Accordingly it can be seen from FIGS. 3 and 4 that the relative position of the cam to the link has been adjusted, by inserting an appropriate tool in the screwdriver slot 35*a* or hexagonal recess in the screw 35 to release the cam for relative rotational adjustment, the screw thereafter being retightened. As shown in FIGS. 3 and 4, the adjusted position is at 90° from the FIG. 1 position so that the nose part 27 now projects outwardly through the slots 43 and 47 so that the abutment member is engaged by extension of the bolt 13 earlier than with the FIG. 1 operation, so that accordingly the full extension of the bolt 13 again moves the link to its rearward position shown in FIG. 4, where the swivel bolts 21 are fully extended. Accordingly by appropriate adjustment of the relative position of the cam on the link 23, (stepless adjustability), different clearances between the door and its frame can be compensated for so as in all instances to provide a full throw of the swivel bolts. It will of course be appreciated that these fastening bolts can be other than swivel bolts, for example the movement of the link could be translated into sliding movement of appropriate upper and lower bolts. Access to the screw 35 is possible by undoing the appropriate screws and removing the cover box 37 and faceplate 40. Moreover the bolt 13 could be a deadbolt, instead of a spring loaded bolt, and key operated.

As previously mentioned, the faceplate and the cover box are relatively adjustable and this adjustment is illustrated in FIGS. 5 and 6. FIG. 5 shows an arrangement where the side surfaces 14,16 respectively of the door and the frame are in line, and with this arrangement, illustrated for a poor wide-gap fitting door, the faceplate is fixed to the cover box with the fixing screw 46 shown at one end of the faceplate slot 45. With this arrangement the slot 47 in the faceplate is aligned with the bolt and the nose part 27 of the cam projects through said slot 47 at one side thereof, in a position to be engaged by the bolt when it is thrown.

If however the respective side surfaces 14 and 16 are not aligned, as shown in FIG. 6, the relative positions of the faceplate and the cover box shown in FIG. 5 would not be suitable to allow the bolt to engage the cam, in that part of the faceplate would block such movement. However by allowing for relative adjustment movement between the faceplate and the cover box, this misalignment of the surfaces 14,16 can be overcome. As shown in FIG. 6, the fixing screw 46 is now positioned in the slot 45 at the opposite end thereof to that shown in FIG. 5, so that the bolt can now still pass through the slot 47 with which it is aligned and also the slot 43, with the nose part 27 now being at the opposite side of the rectangular slot 47 to that shown in FIG. 5. Accordingly the adjustment allows for compensation for different relative dispositions between the door and the frame, and in particular the cover box fitted at said frame. It will be noted that, for simplicity, the sections through the cam, faceplate adjustment slots/screws and fixing spacers have been shown on a common section line, though in practice this would not be the case.

It will be appreciated that if the clearances shown in FIGS. 1 and 3 respectively are extremes, it is possible to cater for any clearance in between these extremes merely by angularly adjusting the cam relative to the link as appropriate, given that this will bring part of the arcuate surface 36 to a position where when it is engaged by the bolt 13, it is moved sufficiently rearwardly so as filly to extend the bolts 21 via the link 23. The cam surface thus provides the facility for stepless adjustability, as previously mentioned.

What is claimed:

1. A door fastening device for use with a door that is movable, in use, between an open position and a closed position, the door fastening device comprising a casing, a bolt movable between a retracted position and an extended position where at least part of the bolt extends through an opening in the casing to fasten the door, in use, the bolt being linked to an abutment member by a single link, said part of the bolt being movable to its extended position by engagement, of a bolt member of a lock or latch of the door with said abutment member, said abutment member being mounted on the link and adjustable to compensate for different clearances, in use, between the casing and the door in its closed position, to ensure sufficient engagement of the abutment member by the bolt member to move said part of the bolt to its extended position, a faceplate with an opening for passage of said bolt member, and means for relative fixing adjustment between the faceplate and the casing to compensate for different relative dispositions, in use, between the door and the casing.

2. A door fastening device as claimed in claim 1, wherein for effecting adjustment thereof, the abutment member is angularly movable about an axis which is normal to a plane which is itself normal to at least a part of the casing having said opening therein.

3. A door fastening device as claimed in claim 1, wherein said abutment member is on one side of a link which is connected to said bolt.

4. A door fastening device as claimed in claim 3, wherein when the abutment member is engaged, in use, by the bolt member of said lock or latch, it effects movement of said link in a direction away from said opening in the casing.

5. A door fastening device as claimed in claim 1, wherein the abutment member is in the form of a cam having a rotational axis, the cam having respective first and second external surfaces which are substantially at 90E to one another and at different radial distances respectively from said rotational axis.

6. A door fastening device as claimed in claim 5, wherein said first external surface extends across the whole axial length of the cam.

7. A door fastening device as claimed in claim 5, wherein said second external surface extends axially for only part of the length of the cam, said part defining a nose part.

8. A door fastening device as claimed in claim 5, wherein the cam is adjustable by slackening a screw on which the cam is carried and which defines said rotational axis.

9. A door fastening device as claimed in claim 8, wherein said casing is adapted to be secured to a frame of the door, in use, and is removable therefrom to allow access to said adjustment screw.

10. A door fastening device as claimed in claim 1, wherein said bolt is a swivel bolt.

11. A door fastening device as claimed in claim 9, wherein said bolt is a swivel bolt pivotally mounted to a housing adapted to be secured, in use, to said frame and covered by said casing.

12. A door fastening device as claimed in claim 1, wherein the casing has an opening therein through which, in use, the bolt member of the lock or latch extends, and a screw hole for receiving a screw for fixing the casing to a frame of the door, said faceplate having a slot therein adapted to receive said screw at one position therein, and thereby secure the faceplate to the casing in one selected relative position of alignment, in use, between the respective openings in the casing and the faceplate, corresponding to one disposition between the door and the casing, the screw being releasable to allow sliding of the faceplate relative to the casing and then being re-tightened at another position in said slot thereby to secure the faceplate to the casing in another selected relative position of alignment of the respective openings in the casing and the faceplate, corresponding to a different disposition between the door and the casing, in use.

13. A door fastening device as claimed in claim 12, wherein the faceplate is received in a recessed portion of the casing in which said opening is formed.

14. A door fastening device as claimed in claim 11, wherein the opening in the casing is wider than the opening in said faceplate.

15. A door fastening device as claimed in claim 1, comprising two bolts, each movable between a retracted position and an extended position where at least part of the bolt extends through an opening in the casing to fasten the door, in use, the bolts being disposed at upper and lower positions respectively in the casing and being linked together by a link which carries the abutment member, so that, in use, the bolt member engages and moves said abutment member thereby effecting extension of said at least part of each bolt through its associated opening respectively.

16. A door fastening device comprising a bolt movable between a retracted position and an extended position where at least part of the bolt extends, in use, to fasten the door, the bolt being linked to an abutment member by a single link, said part of the bolt being movable to its extended position in engagement, of a bolt member of a lock or latch of the door with said abutment member, said abutment member being a cam mounted on the link, the cam being adjustable to compensate for different clearances, in use, between the device and the door in its closed position, to ensure sufficient engagement of the abutment member by the bolt member to move said part of the bolt to its extended position, and the cam having a flat, first surface and a second surface on a nose part.

17. A door fastening device as claimed in claim 16, wherein said cam is angularly movable about a rotational axis.

18. A door fastening device as claimed in claim 17, wherein the second surface extends radially further from said rotational axis than the first surface.

19. A door fastening device as claimed in claim 16, wherein the first and second surfaces are alternately directed to face outwardly of said opening in the casing by angular adjustment movement of the cam through 90°.

20. A door fastening device as claimed in claim 16, wherein the first surface extends across the whole axial length of the cam.

21. A door fastening device as claimed in claim 16, wherein the second surface extends axially for only part of the axial length of the cam.

22. A door fastening device as claimed in claim 16, wherein the second surface is arcuate.

23. A door fastening device as claimed in claim 16, wherein the cam has a flat end surface engaged against a flat side of a link connected to said bolt, the cam being secured to said link by a screw defining a rotational axis of the cam and being releasable to allow angular movement of the cam relative to said link.

24. A door fastening device as claimed in claim 23, wherein at its respective opposite ends, the link is pivotally connected to a pair of swivel bolts, each of which is pivotally mounted for swinging movement at its respective associated casing opening.

25. A door fastening device for use with a door that is movable, in use, between an open position and a closed position, the door fastening device comprising a casing, a bolt movable between a retracted position and an extended position where at least part of the bolt extends through an opening in the casing to fasten the door, in use, the bolt being linked to an abutment member, said part of the bolt being movable to its extended position by engagement of a bolt member of a lock or latch of the door with said abutment member, said abutment member being adjustable to compensate for different clearances, in use, between the casing and the door in its closed position, to ensure sufficient engagement of the abutment member by the bolt member to move said part of the bolt to its extended position, a faceplate with an opening for passage of said bolt member, and means for relative fixing adjustment between the faceplate and the casing to compensate for different relative dispositions, in use, between the door and the casing, the abutment member being in the form of a cam having a rotational axis, the cam having respective first and second external surfaces which are at 90° to one another and at different radial distances respectively from said rotational axis, said first external surface extending across the whole length of the cam, said second external surface extending axially for only part of the length of the cam, and the cam being adjustable by slackening a screw on which the cam is carried and which defines said rotational axis.

26. A door fastening device comprising a bolt movable between a retracted position and an extended position where at least part of the bolt extends, in use, to fasten the door, the bolt being linked to an abutment member, said part of the bolt being movable to its extended position by engagement of a bolt member of a lock or latch of the door with said abutment member, said abutment member being a cam which is adjustable to compensate for different clearances, in use, between the device and the door in its closed position, to ensure sufficient engagement of the abutment member by the bolt member to move said part of the bolt to its extended position, and the cam having a flat, first surface and a second surface on a nose part, wherein the cam is angularly movable about a rotational axis, the first and second surfaces are alternately directed to face outwardly of said opening in the casing by angular adjustment movement of the cam through 90°, and the cam has a flat end surface engaged against a flat side of a link connected to said bolt, the cam being secured by said link by a screw defining a rotational axis of the cam and being releasable to allow angular movement of the cam relative to said link.

27. A door fastening device comprising a housing, a pair of bolts each movable between a retracted position and an extended position where at least part of the bolt extends, in use, to fasten a door, the bolts being pivotally mounted in the housing about respective first and second pivots, and the bolts being pivotally connected at respective third and fourth pivots spaced from the first and second pivots respectively, to respective opposite ends of a single link, a cam being adjustably mounted on the link, said part of each bolt being movable to its extended position by engagement of a bolt member of a lock or latch of the door with said cam, the cam being mounted on the link for angular adjustment movement relative to the link, about an axis defined by a fixing screw, to compensate for different clearances, in use, between the device and the door in its closed position, to ensure sufficient engagement of the cam by the bolt member to move said part of each bolt to its extended position, the cam having an extended, flat first external surface and a second external surface on a nose part of the cam, the cam being angularly adjustable, in use, through 90° about its axis by release of said fixing screw, between a first extreme position, where the extended, flat, first surface is arranged for engagement by said bolt member to compensate for clearances between the door and a casing, and a second extreme position, where the second surface on the nose part of the cam is arranged for engagement by said bolt member, the first and second surfaces being at different radial differences respectively from the cam axis, the fixing screw being tightened in any selected adjusted position of the cam so that the cam is then held fast with said link and moves therewith, a flat end surface of the cam being engaged against a flat side of the link.

28. A door fastening device as claimed in claim 27, wherein said first surface extends across the whole axial length of the cam.

29. A door fastening device as claimed in claim 27, wherein the second surface extends axially for only part of the length of the cam, said part defining said nose part.

30. A door fastening device as claimed in claim 27, wherein the housing is received in a casing adapted to be secured to a frame of the door, in use, the casing being removable therefrom to allow access to said fixing screw on which the cam is mounted.

* * * * *